US007973225B2

(12) United States Patent
Goto

(10) Patent No.: US 7,973,225 B2
(45) Date of Patent: Jul. 5, 2011

(54) PEG FOR STRINGED INSTRUMENT

(75) Inventor: Masaki Goto, Isesaki (JP)

(73) Assignee: Gotoh Gut Co., Ltd. (JP)

( * ) Notice: Subject to any disclaimer, the term of this patent is extended or adjusted under 35 U.S.C. 154(b) by 0 days.

(21) Appl. No.: 12/706,758

(22) Filed: Feb. 17, 2010

(65) Prior Publication Data

US 2010/0242704 A1 Sep. 30, 2010

(30) Foreign Application Priority Data

Mar. 30, 2009 (JP) ..... 2009-080995

(51) Int. Cl.
*G10D 3/14* (2006.01)

(52) U.S. Cl. ..... 84/306; 84/304

(58) Field of Classification Search ..... 84/304, 84/306

See application file for complete search history.

(56) References Cited

U.S. PATENT DOCUMENTS

| | | | | | |
|---|---|---|---|---|---|
| 322,272 | A * | 7/1885 | Forrest | 84/306 |
| 726,706 | A * | 4/1903 | Lang | 84/306 |
| 2,448,308 | A * | 8/1948 | Gregg | 84/306 |
| 3,431,807 | A * | 3/1969 | Thompson | 84/306 |
| 3,496,825 | A * | 2/1970 | Wustl | 84/306 |
| 3,982,462 | A * | 9/1976 | Schaller | 84/306 |
| 4,098,163 | A * | 7/1978 | Kato | 84/306 |
| 4,353,280 | A * | 10/1982 | Spercel | 84/306 |
| 4,515,059 | A * | 5/1985 | Siminoff | 84/306 |
| 4,860,627 | A * | 8/1989 | Sloane | 84/306 |
| 4,945,800 | A * | 8/1990 | Schaller | 84/306 |
| 4,974,481 | A * | 12/1990 | Gilbert | 84/306 |
| 5,728,955 | A * | 3/1998 | Sperzel | 84/306 |
| 5,747,712 | A * | 5/1998 | Goto | 84/306 |
| 6,172,287 | B1 * | 1/2001 | Kang | 84/304 |
| 6,580,022 | B2 * | 6/2003 | Kang | 84/304 |
| 6,815,596 | B2 * | 11/2004 | Goto | 84/304 |
| 6,989,482 | B2 * | 1/2006 | Goto | 84/304 |
| 7,102,065 | B2 * | 9/2006 | Sperzel | 84/304 |
| 7,304,226 | B2 * | 12/2007 | Harris | 84/304 |
| 7,488,879 | B2 * | 2/2009 | Gotoh | 84/304 |
| 7,521,615 | B1 * | 4/2009 | Ho et al. | 84/304 |
| 2007/0012158 | A1 * | 1/2007 | Kang | 84/304 |
| 2010/0242704 | A1 * | 9/2010 | Goto | 84/304 |

* cited by examiner

*Primary Examiner* — Jeffrey Donels
*Assistant Examiner* — Robert W Horn
(74) *Attorney, Agent, or Firm* — Thompson Hine LLP

(57) ABSTRACT

The mounting position of a winding shaft on a main body is changed, and a peg may be mounted in various stringed instruments by miniaturizing the main body or reducing the thickness thereof. The peg for the stringed instrument includes a main body mounted in the stringed instrument; a worm rotatably supported by the main body, the worm having a knob at an end thereof; a worm wheel engaging with the worm, the worm wheel rotatably supported by the main body; a winding shaft connecting to one side of the worm wheel in an axial direction, the winding shaft for winding a string of the stringed instrument; and bearing holes formed in at least two surfaces of the main body, the bearing holes supporting the winding shaft rotatably.

8 Claims, 7 Drawing Sheets

PEG FOR STRINGED INSTRUMENT

BACKGROUND OF THE INVENTION

1. Field of the Invention

The present invention relates to a peg for a stringed instrument such as a guitar, and particularly relates to a peg for a stringed instrument that can change the mounted position of a winding shaft on a main body.

2. Description of Related Art

A stringed instrument, such as a guitar, has a peg for tuning a string. As shown in FIG. 11, the peg has a main body 110, a worm 120, a knob 130, a winding shaft 140, and a worm wheel 150. The main body 110 supports the worm 120 rotatably. The knob 130 is secured at an end of the worm 120. The main body 110 supports the winding shaft 140 rotatably. The worm wheel 150 connects to an end of the winding shaft 140 and engages with the worm 120.

In the above peg 100, the winding shaft 140 penetrates a hole 200*a* formed in the head 200 of the stringed instrument. A winding surface 141 of the winding shaft 140 projects from the hole 200*a*. The main body 110 is secured on a lower surface of the head 200 by a screw. As a result, the peg 100 is mounted in the head 200. A string is wound around the winding shaft 140. The string is wound therearound or released therefrom by rotating the knob 130, so that tuning of the stringed instrument is performed. A guide bush 160 is inserted into the hole 200*a* from an upper surface of the head 200. A screw on the outside of a small diameter portion in a front end of the guide bush 160 is tightened in the inside of a guide tube 110*a*. As a result, the main body 110 and the guide bush 160 support the winding shaft 140 rotatably, and the main body is secured to the head 200. For example, a peg having such a structure is disclosed in Japanese Unexamined Patent Application Publication No. 2006-154435.

SUMMARY OF THE INVENTION

In stringed instruments in which pegs are mounted, there are various kinds. Various pegs are manufactured depending on the shape and the space of the stringed instrument. For example, in the above peg 100, the main body 110 must be secured to the lower surface of the head 200 of the stringed instrument according to the size thereof. In addition, in order for the winding shaft 140 to protrude from the upper surface of the head 200, the winding shaft 140 must be mounted at the backside of the main body 110, and the hole 200*a* must be provided in the head 200. Furthermore, the guide bush 160 and the guide tube 110*a* for guiding the winding shaft 140 in the hole 200*a* is necessary. Therefore, stringed instruments in which the peg 100 of such a construction can be mounted are limited.

An object of the present invention is to provide a peg for a stringed instrument that can change the mounted position of a winding shaft on a main body, and to provide the peg for the stringed instrument that can be mounted in various stringed instruments by miniaturizing the main body and by reducing the thickness thereof.

The present invention is a peg for a stringed instrument including a main body mounted in the stringed instrument; a worm rotatably supported by the main body, the worm having a knob at an end thereof; a worm wheel engaging with the worm, the worm wheel rotatably supported by the main body; a winding shaft connecting to one side of the worm wheel in an axial direction, the winding shaft for winding a string of the stringed instrument; and bearing holes formed in at least two surfaces of the main body, the bearing holes supporting the winding shaft rotatably.

According to the peg for the stringed instrument of the present invention, bearing holes are formed in at least two surfaces of the main body, and the bearing holes rotatably support the winding shaft. Therefore, the winding shaft can be mounted at any one of at least two surfaces. In particular, when the winding shaft is mounted at the upper surface of the main body, the main body of the peg can be mounted at the upper surface of the head of the stringed instrument. According to this aspect, in the head of the stringed instrument, a hole for inserting the winding shaft is not necessary. In addition, a guide bush and a guide tube that are inserted into this hole are also not necessary. Therefore, the number of parts, the number of manufacturing processes, and the costs of manufacturing can be decreased.

As a means for supporting the winding shaft rotatably by the main body, various compositions can be adopted. For example, bearing holes that are formed in at least two surfaces of the main body can directly support the winding shaft. In addition, a second aspect of the present invention is the peg for the stringed instrument further including bearings connecting to these bearing holes. When the main body of the peg is small or thin, these bearings can supplement the strength of the main body. Furthermore, the winding shaft is supported rotatably by bearing holes or bearings that are formed in at least two surfaces of the main body. Therefore, the winding shaft is not easily inclined toward the head of the stringed instrument even if the tension of the string is strong.

In addition, a third aspect of the present invention is the peg for the stringed instrument further including a wheel shaft provided at another side of the worm wheel in an axial direction, the wheel shaft rotating unitarily with the winding shaft. According to this aspect, since a rotational shaft of the worm wheel is composed of two portions of the winding shaft and the wheel shaft that are connecting to both ends in an axial direction, the winding shaft can be easily mounted or unmounted from the worm wheel. Therefore, the mounted position of the winding shaft on the main body can be easily changed. In addition, a fourth aspect of the present invention is the peg for the stringed instrument, in which the wheel shaft is caught at the edge of a small diameter hole that is formed at the inside of the worm wheel. According this aspect, since the winding shaft is united with the wheel shaft, the winding shaft can be prevented from coming off from the worm wheel.

Furthermore, a fifth aspect of the present invention is the peg for the stringed instrument further including bearing holes that are formed in at least two surfaces of the main body, the bearing holes supporting the worm rotatably. Since the bearing holes supporting the worm rotatably are formed in at least two surfaces of the main body, the worm can be mounted at any one of the surfaces. Therefore, the mounted position of the worm on the main body can be changed depending on the shape and the space of the stringed instrument.

As well as in the case of the above winding shaft, various compositions can be adopted as a means for supporting the worm rotatably by the main body. The bearing holes can directly support the worm. In addition, a sixth aspect of the present invention is the peg for the stringed instrument further including bearings connecting to these bearing holes. When the main body of the peg is small or thin, these bearings can supplement the strength of the main body.

In addition, in the peg for the stringed instrument of the present invention, various compositions can be adopted as a method for mounting on the stringed instrument. For example, a seventh aspect of the present invention is the peg for the stringed instrument, wherein the winding shaft is mounted at the upper surface of the main body, and the main body is mounted at the upper surface of the head of the stringed instrument. According to this aspect, in the head of the stringed instrument, a hole for inserting the winding shaft is not necessary. In addition, a guide bush and a guide tube for inserting into this hole are also not necessary. Therefore, the number of parts, the number of manufacturing processes, and the costs of manufacturing can be decreased.

Furthermore, an eighth aspect of the present invention is the peg for the stringed instrument, wherein the winding shaft is mounted at the lower surface of the main body, and the main body is mounted in an indentation that is formed on the lower surface of the head of the stringed instrument. According to this aspect, since there is no projection on the lower surface of the head of the stringed instrument, the stringed instrument can be played easily. In addition, if this indentation is concealed by a resin, etc., a beautiful stringed instrument can be provided.

According to the present invention, the mounted position of the winding shaft on the main body can be changed, and the peg can be mounted in various stringed instruments by miniaturizing of the main body or reducing of the thickness thereof.

DETAILED DESCRIPTION OF THE PREFERRED EMBODIMENTS

1. First Embodiment

Figure 1:
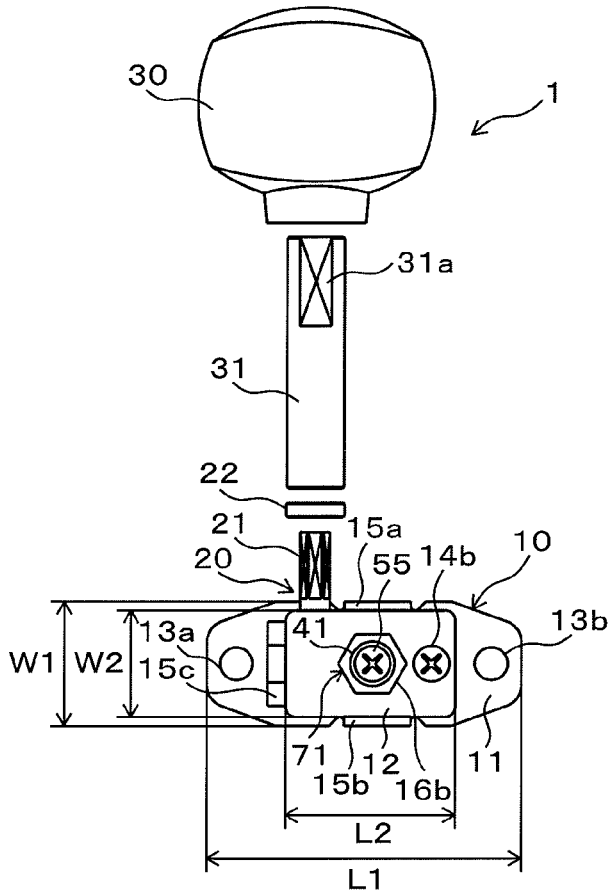
FIG. 1 is a top view of a peg in a first embodiment.
Figure 2:
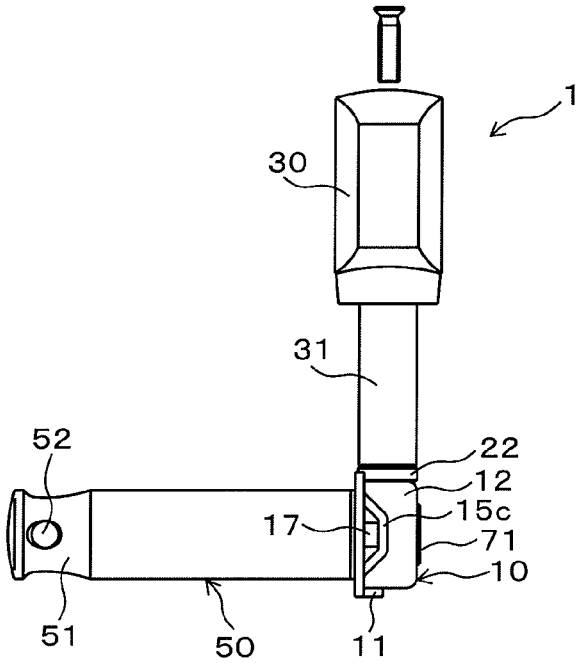
FIG. 2 is a side view of a peg in a first embodiment.
Figure 3:
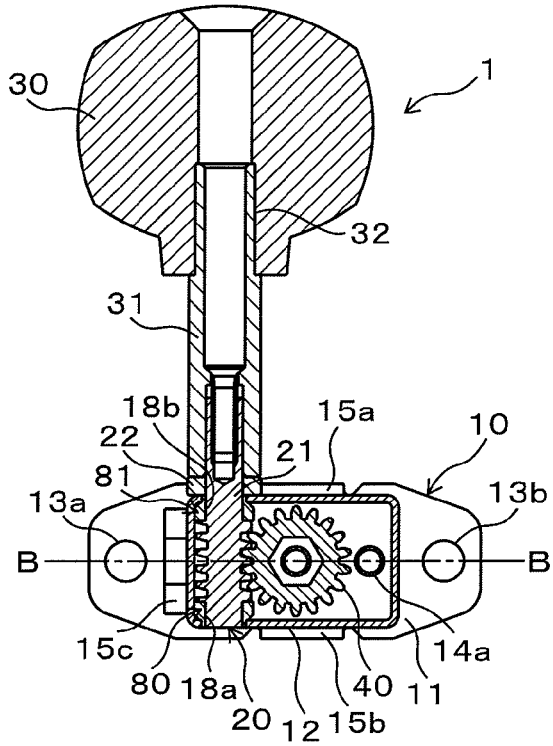
FIG. 3 is a sectional view of a peg in a first embodiment, the sectional view taken along line A-A in FIG. 4.
Figure 4:
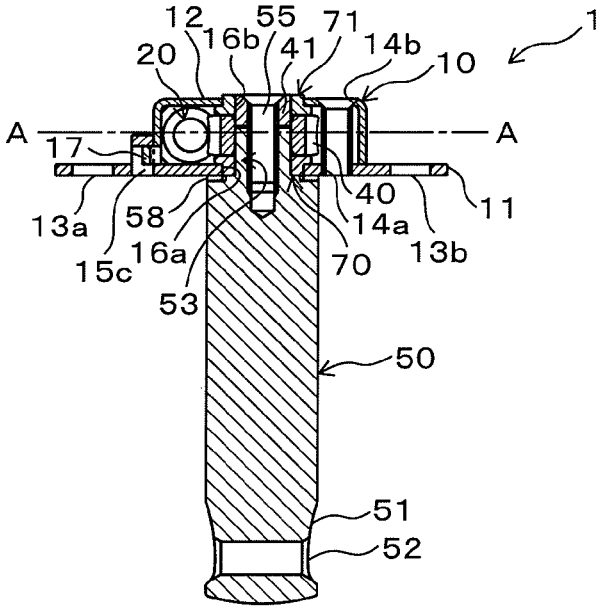
FIG. 4 is a sectional view of a peg in a first embodiment, the sectional view taken along line B-B in FIG. 3.
Figure 5:
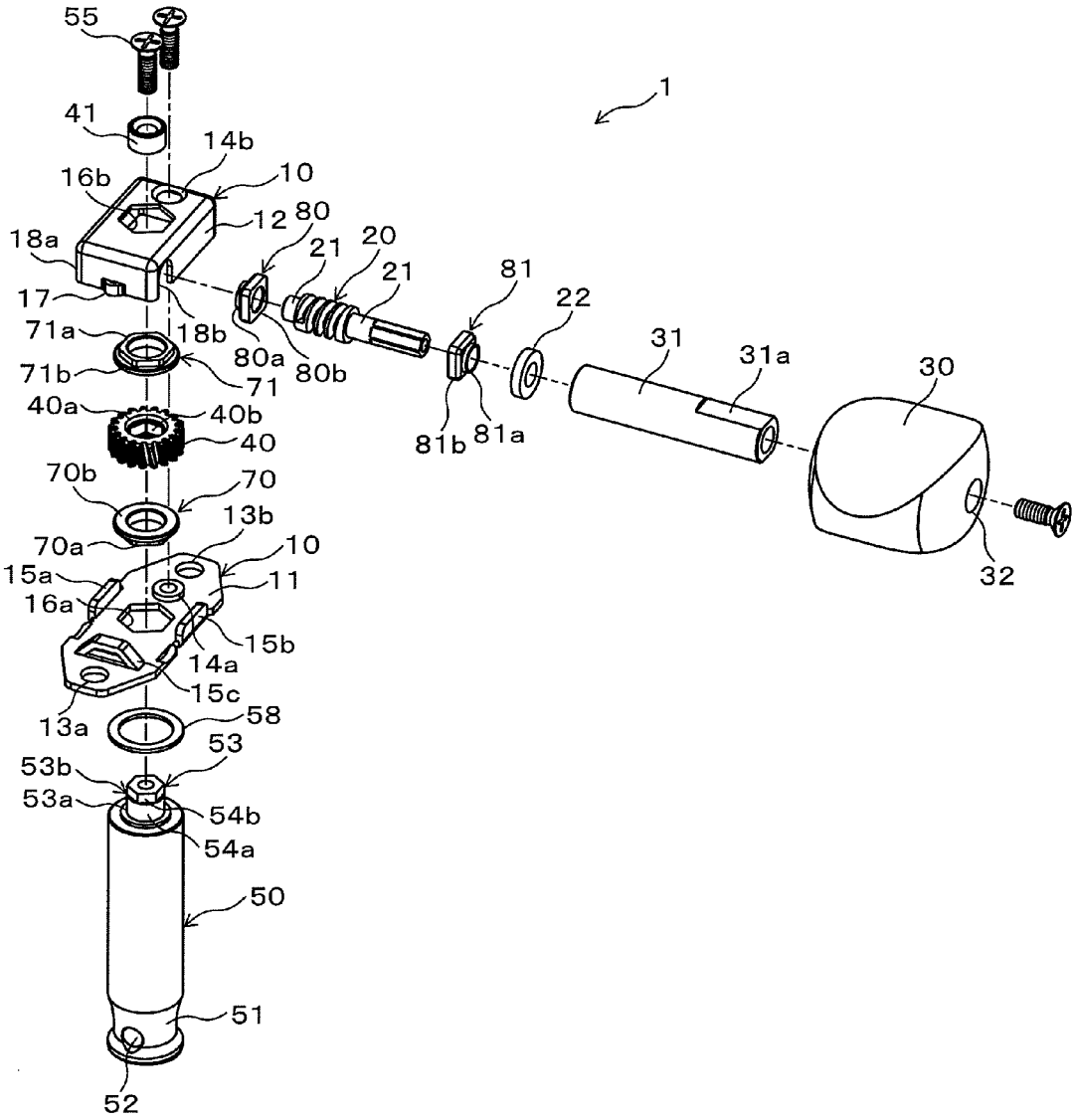
FIG. 5 is an exploded perspective view of a peg in a first embodiment.

A peg in a first embodiment will be described hereinafter referring to FIGS. 1 to 5. FIGS. 1 and 2 are a top view and a side view of a peg. FIGS. 3 and 4 are sectional views of a peg, the sectional views taken along line A-A and along line B-B. FIG. 5 is an exploded perspective view of a peg.

First, an outline of a composition of a peg 1 is described. A reference symbol 10 is a main body of the peg 1. The main body 10 supports a worm 20 rotatably. A knob 30 for rotating the worm 20 is mounted on the worm 20. A worm wheel 40 engages with the worm 20. A winding shaft 50 is inserted into the worm wheel 40.

Next, each part of the peg 1 is described in detail. The main body 10 is composed of a base plate 11 and a cover 12. The base plate 11 is formed by performing press-working on a metal plate such as SUS 304. For example, L1 is a length of 21.2 mm, and W1 is a width of 8.4 mm. Mounting holes 13*a* and 13*b* are formed at both ends of the base plate 11. The mounting holes 13*a* and 13*b* are used for mounting the base plate 11 on a head of a stringed instrument (not shown in the figure) by a screw etc. A mounting hole 14*a* is formed near the mounting hole 13*b*. The mounting hole 14*a* is used for mounting the cover 12 on the base plate 11. In addition, projections 15*a* to 15*c* are formed at the base plate 11. The projections 15*a* to 15*c* adjust the position of the cover 12.

In addition, a bearing hole 16*a* is formed in the center of the base plate 11. The bearing hole 16*a* is used for supporting the winding shaft 50 rotatably. A bearing 70 is inserted into the bearing hole 16*a*. The bearing 70 supports the winding shaft 50 rotatably. The bearing hole 16*a* is hexagonal and obstructs relative rotation of the bearing 70 for the base plate 11. The bearing 70 is formed by a metal such as brass and is composed of a positioning portion 70*a* and a flange 70*b*. The positioning portion 70*a* is hexagonal and is inserted into the bearing hole 16*a* of the base plate 11. The flange 70*b* prevents the bearing 70 from coming off from the base plate 11 and supports the worm wheel 40 rotatably.

The cover 12 is formed by performing bend-working on a cross-shaped metal plate such as SUS 304. For example, L2 is a length of 11.5 mm, and W2 is a width of 7.2 mm. A bearing hole 16*b* is formed in the center of the cover 12. The bearing hole 16*b* is used for supporting a wheel shaft 41 rotatably. A bearing 71 is inserted into the bearing hole 16*b*. The bearing 71 supports the wheel shaft 41 rotatably. The bearing hole 16*b* is hexagonal and obstructs relative rotation of the bearing 71 for the cover 12. The bearing 71 is formed of a metal such as brass and is composed of a positioning portion 71*a* and a flange 71*b*. The positioning portion 71*a* is hexagonal and is inserted into the bearing hole 16*b* of the cover 12. The flange 71*b* prevents the bearing 71 from coming off from the cover 12 and supports the worm wheel 40 rotatably.

Bearing holes 16*a* and 16*b* can be formed in at least two surfaces of the main body 10. For example, bearing holes 16*a* and 16*b* can be formed in the side of the main body. In addition, since inside diameters of the bearings 70 and 71 are the same, the winding shaft 50 can be mounted at any surface of the main body 10.

In addition, bearing holes 18*a* and 18*b* are formed in at least two sides of the cover 12. The bearing holes 18*a* and 18*b* are used for supporting the worm 20 rotatably. The bearing holes 18*a* and 18*b* are formed in a U-shape, and bearings 80 and 81 are inserted into bearing holes 18*a* and 18*b*. The bearings 80 and 81 support the worm 20 rotatably. The bearings 80 and 81 are composed of mounting portions 80*a* and 81*a* and flanges 80*b* and 81*b*. The mounting portions 80*a* and 81*a* are cylindrical, and flanges 80*b* and 81*b* are non-cylindrical (cubic). The cylindrical mounting portions 80*a* and 81*a* are inserted into bearing holes 18*a* and 18*b*. The cubic flanges 80*b* and 81*b* are caught at an inside wall of the cover 12. As a result, flanges 80*b* and 81*b* obstructs relative rotation of the bearings 80 and 81 for the cover 12.

Bearing holes 18*a* and 18*b* can be formed in at least two surfaces of the main body 10. For example, bearing holes 18*a* and 18*b* can be formed in the upper surface (side of the cover 12) and the lower surface (side of the base plate 11) of the main body. In addition, since inside diameters of the bearings 80 and 81 are the same, the worm 20 can be mounted at any surface of the main body 10.

A worm shaft 21 is formed at both ends of the worm 20. The worm shaft 21 is supported rotatably by the bearings 80 and 81. In addition, a washer 22 is inserted into the worm shaft 21. The washer 22 lessens friction at the side of the cover 12 of a knob shaft 31.

In addition, an end of the worm shaft 21 is hexagonal and is inserted in the knob shaft 31. A notch 31*a* is formed at an end of the knob shaft 31 and obstructs relative rotation of the knob 30. The knob 30 is mounted at the notch 31. On the other hand, the knob 30 has a penetrating hole 32 for mounting the knob shaft 31. A screw is inserted into the penetrating hole 32 and is tightened in the worm 20. As a result, the knob 30 and the knob shaft 31 are united with the worm 20.

In addition, a projection 17 is formed on the side of the cover 12. The projection 17 is inserted into the projection 15*c* of the base plate 11. In addition, a mounting hole 14*b* is formed on the cover 12. The mounting hole 14*b* is used for mounting the cover 12 on the base plate 11 by a screw. The screw is inserted into the mounting hole 14*b* of the cover 12 and is tightened in a mounting hole 14*a* of the base plate 11.

A winding surface 51 is formed at an end of the winding shaft 50. The winding surface 51 diminishes a diameter thereof like an arc. A penetration hole 52 is formed in the winding surface 51. An end of a string is inserted into the penetration hole 52, and the string begins to be wound. A mounting shaft 53 is formed at the other end of the winding shaft. The mounting shaft 53 is composed of a large diameter shaft 53*a* and a small diameter shaft 53*b*. A washer 58 is inserted into the large diameter shaft 53*a*. The washer 58 decreases rotational resistance between a main body 10 and a winding shaft 50. In addition, a small diameter shaft 53*b* has a columnar portion 54*a* and a hexagonal portion 54*b*. The bearing 70 supports the columnar portion 54*a* rotatably. The hexagonal portion 54*b* is inserted into the worm wheel 40. The hexagonal portion 54*b* obstructs relative rotation of the winding shaft 50 for the worm wheel 40.

An inside of the worm wheel 40 is composed of a large diameter hole 40*a* and a small diameter hole 40*b*. The large diameter hole 40*a* is formed in a column at upper and lower ends of the inside of the worm wheel 40. The small diameter hole 40*b* is formed in a hexagon at the middle of the inside of the worm wheel 40. The winding shaft 50 is mounted at one side of the worm wheel 40 in the axial direction. A wheel shaft 41 is mounted at another side of the worm wheel 40 in the axial direction. The wheel shaft 41 rotates unitarily with the winding shaft 50. A diameter of the wheel shaft 41 is the same as a diameter of the columnar portion 54*a* of the mounting shaft 53 of the winding shaft 50. The bearing 71 supports the wheel shaft 41 rotatably, and the bearing 70 supports the columnar portion 54*a* of the mounting shaft 53 of the winding shaft 50 rotatably.

A screw 55 for tightening a shaft is inserted into the wheel shaft 41 and is tightened to the winding shaft 50. The screw 55 for tightening a shaft unites the worm wheel 40 and the winding shaft 50. In addition, the wheel shaft 41 is caught at the edge of the small diameter hole 40*b* that is formed at the inside of the worm wheel 40. As a result, the winding shaft 50 is united with the wheel shaft 41 and can be prevented from coming off from the worm wheel 40.

Effects in the First Embodiment

Figure 6:
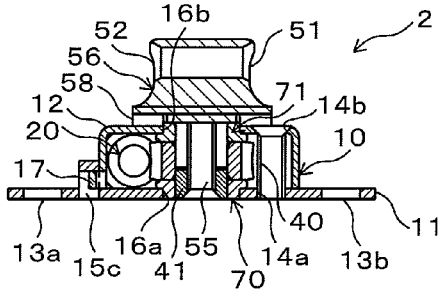
FIG. 6 is a sectional view of a peg in which a winding shaft is mounted at the upper surface of a main body.
Figure 7:
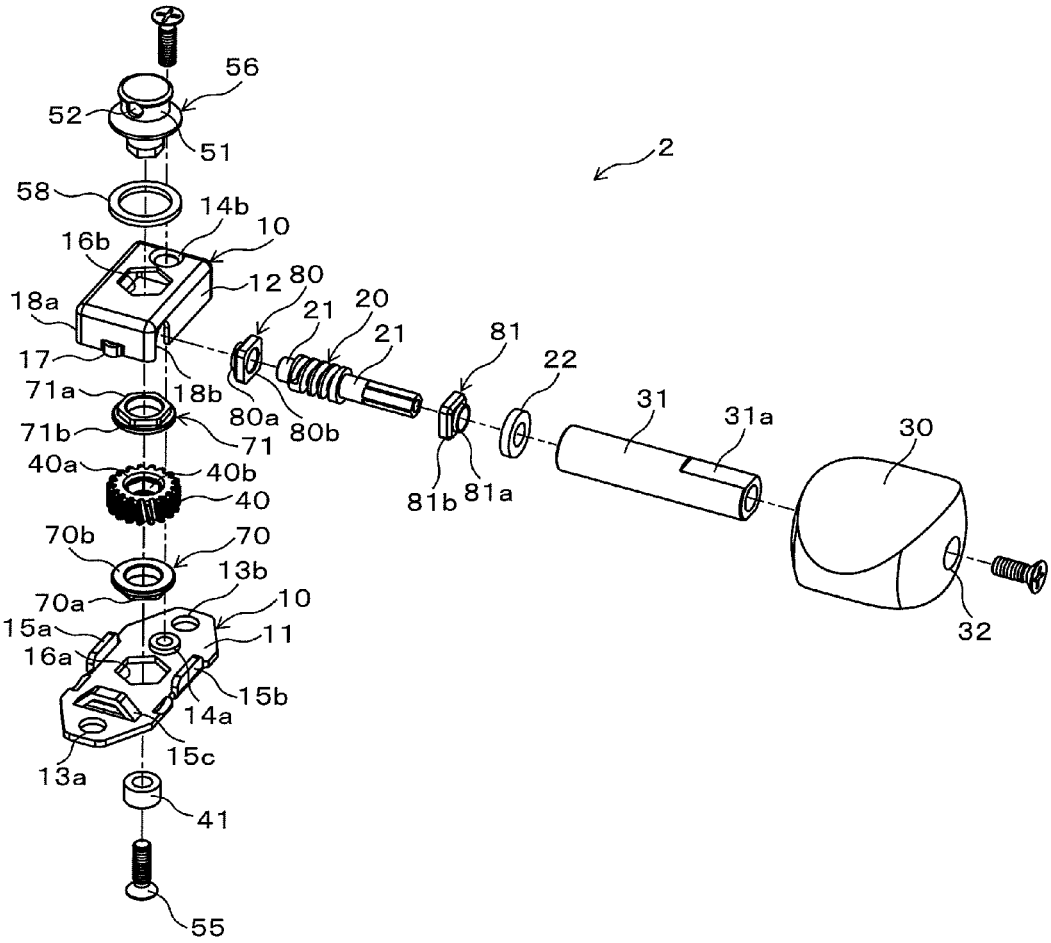
FIG. 7 is an exploded perspective view of a peg in which a winding shaft is mounted at the upper surface of a main body.

The effects of the peg structured as above are described hereinafter. FIG. 6 is a sectional view of a peg in which a winding shaft is mounted at an upper surface of a main body, and FIG. 7 is an exploded perspective view of a peg in which a winding shaft is mounted at an upper surface of a main body. In the peg of the present invention, as shown in FIGS. 4 and 5, the winding shaft 50 can be mounted at the lower surface (side of the base plate 11) of the main body 10. In addition, as shown in FIGS. 6 and 7, a winding shaft 56 can be mounted at the upper surface (side of the cover 12) of the main body 10.

Figure 8A:
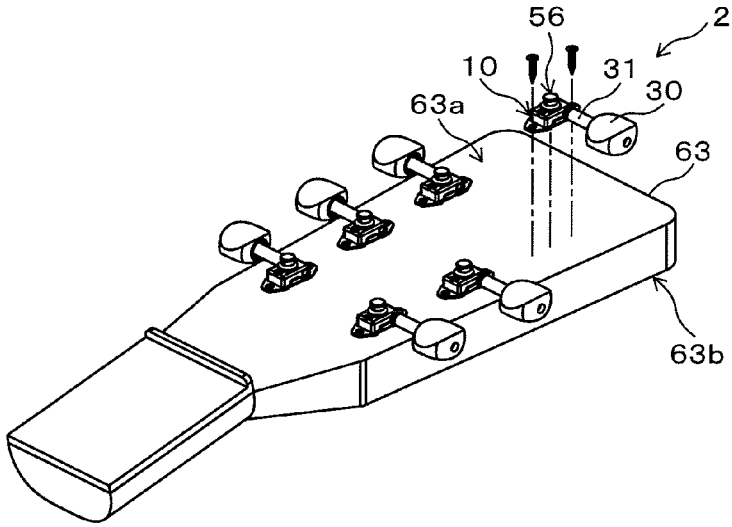
FIGS. 8A and 8B are explanatory views of a method for mounting a peg in a guitar.
Figure 8B:
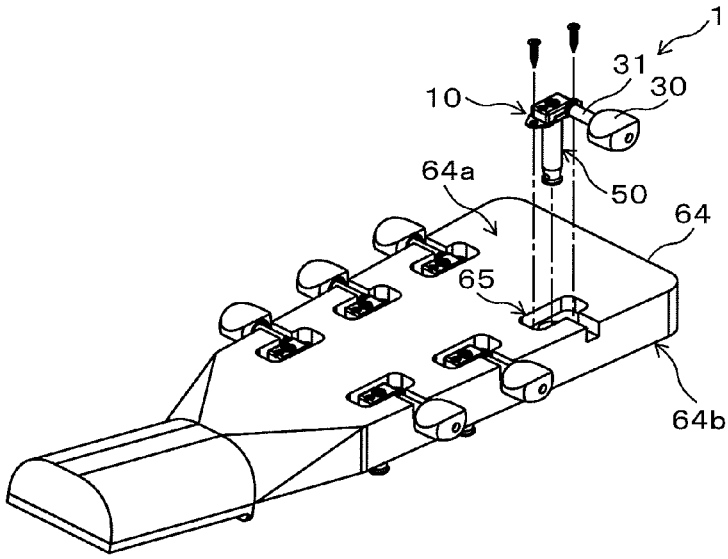

In pegs 1 and 2 having such structures, the following effects are obtained. FIGS. 8A and 8B are explanatory views of a method for mounting a peg on a guitar. In FIG. 8A, the peg 2 in which the winding shaft 56 is mounted at the upper surface of the main body 10 is mounted in a head 63 of a guitar. In this case, the main body 10 of the peg 2 is secured at a front surface 63*a* of the head 63 by a screw. As a result, since a hole for inserting the winding shaft 56 into the head 63 of a guitar and a guide bush are not necessary, the number of parts, the number of manufacturing processes, and the costs of manufacturing can be decreased.

In addition, in FIG. 8B, the peg 1 in which the winding shaft 50 is mounted at the lower surface of the main body 10 is mounted in a head 64 of a guitar. Since the main body 10 of the peg 1 is small and thin, the main body 10 can be embedded in an indentation 65 that is provided at the lower surface 64*a* of the head 64 of a guitar. Furthermore, if this indentation 65 is concealed, the external appearance is beautiful, and the stringed instrument can be played easily because there is no projection. Since the main body 10 of the peg 1 is small and thin, the strength of the head 64 can be maintained even if the indentation 65 is provided.

Furthermore, as another method for mounting the peg, the main body 10 can be mounted at the side of the head as in a classic guitar because the main body 10 is small and thin. In particular, in an electric guitar or a folk guitar, this is effective because a space on the side of the head is small.

In addition, in pegs 1 and 2 of the first embodiment, the winding shaft and knob can be easily exchanged for those of different shape. Therefore, by using the main body, of one kind, the peg can be mounted in a guitar, a violin, a ukulele, a mandolin, a banjo, a shamisen, and numerous other stringed instruments. A method for mounting the peg in a tailpiece of a violin is described hereinafter.

Figure 9A:
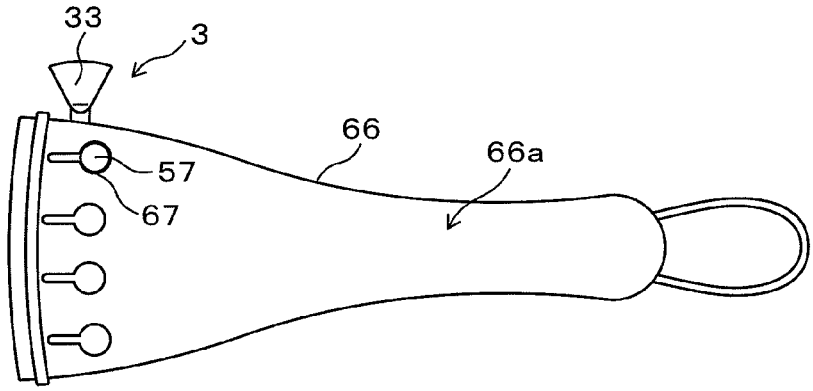
FIGS. 9A and 9B are explanatory views of a method for mounting a peg on a violin.
Figure 9B:
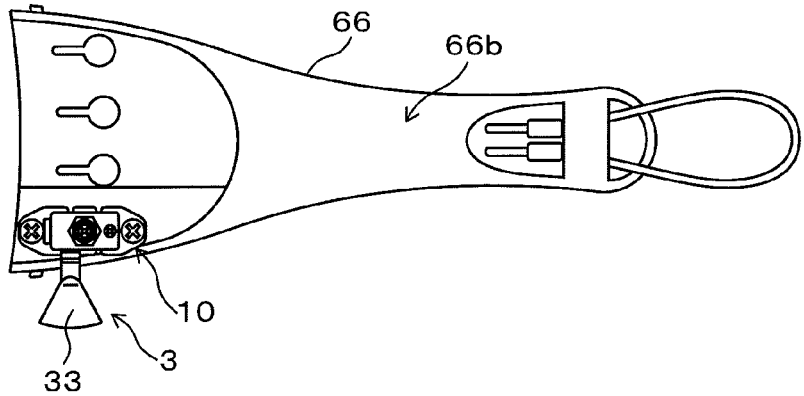

FIGS. 9A and 9B are explanatory views of a method for mounting a peg in a violin. In FIGS. 9A and 9B, a front surface 66*a* and a back surface 66*b* of a tailpiece of a violin are shown. In a peg 3 shown in FIGS. 9A and 9B, the same parts as the peg 1 shown in FIGS. 1 to 5 are used for the main body 10. The winding shaft and knob is exchanged for a smaller winding shaft 57 and a smaller knob 33. This winding shaft 57 is inserted into a hole 67 from the back surface 66*b* of the tailpiece 66 of the violin. The winding surface is projected on the front surface 66*a* of the tailpiece 66. Then, the main body 10 is secured on the back surface 66*b* of the tailpiece 66 by a screw. As a result, since the peg can be mounted in numerous types of stringed instruments by the one kind of main body, the costs of manufacturing can be decreased.

In addition, as shown FIG. 4, in a peg of the present invention, a rotational shaft of the worm wheel 40 is supported rotatably by two bearings 70 and 71 that are provided at both ends in an axial direction. As a result, the winding shaft 50 is not easily inclined toward the head. Therefore, tone quality that was tuned once does not change easily.

2. Second Embodiment

A transformational example of the first embodiment will be described hereinafter. In a second embodiment, a bearing supporting the rotational shaft of the worm wheel is composed of only the main body of the peg. The same reference symbol as in the first embodiment is used to indicate the corresponding component, and explanation thereof is omitted.

Figure 10:
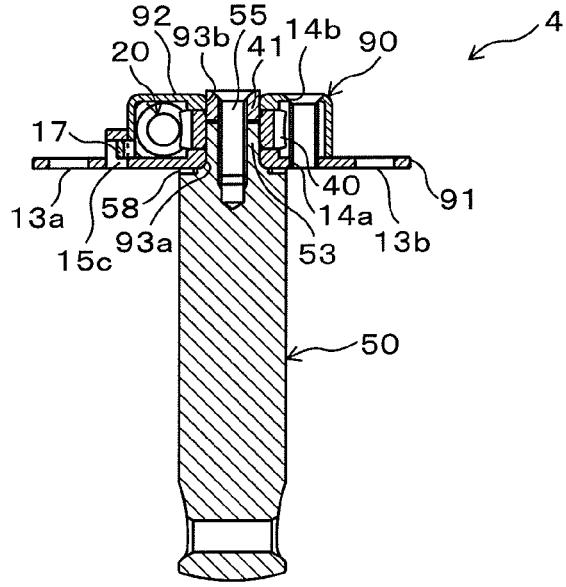
FIG. 10 is a sectional view of a peg in a second embodiment.
Figure 11:
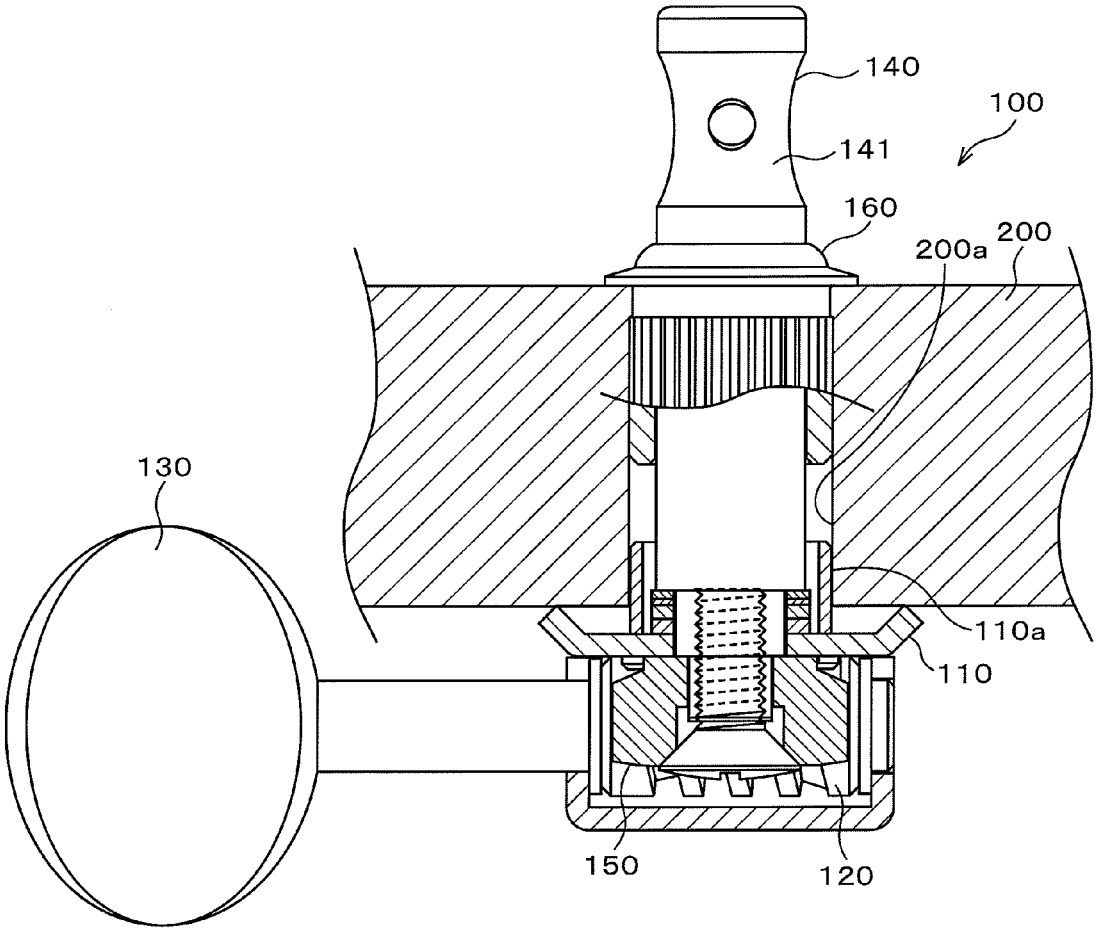
FIG. 11 is a sectional view of a conventional peg.

FIG. 10 is a sectional view of a peg in the second embodiment. A main body 90 of a peg 4 is composed of a base plate 91 and a cover 92. The base plate 91 and the cover 92 are formed by performing press-working on a metal plate such as one of a steel. A bearing hole 93*a* is formed by performing bend-working at the center of the base plate 91. A bearing hole 93*b* is formed by performing bend-working at the center of the cover 92. The mounting shaft 53 of the winding shaft 50 is supported rotatably by the bearing hole 93*a*. The wheel shaft 41 is supported rotatably by the bearing hole 93*b*.

Since the bearing hole 93*a* and the bearing hole 93*b* are circular with the same diameter, the winding shaft 50 can be mounted at a lower surface (side of the base plate 91) of the main body 90 and an upper surface (side of the cover 92) of the main body 90. When the winding shaft 50 is mounted at the upper surface of the main body 90, the winding shaft 50 is inserted into the worm wheel 40 from the side of the cover 92, and the wheel shaft 41 is inserted into the worm wheel 40 from the side of the base plate 91. The screw 55 for tightening a shaft is inserted from the side of the base plate 91 and is tightened to the mounting shaft 53 of the winding shaft 50. As a result, the mounted position of the winding shaft 50 on the main body 90 can be changed.

In addition, by the same method, bearings 80 and 81 shown in FIG. 3 can be integrated with the cover 12 of the main body 10. Furthermore, the wheel shaft 41 and the screw 55 for tightening a shaft can be integrated. According to these modes, the number of parts and the number of manufacturing processes can be decreased.

Effects in the Second Embodiment

When the main body 90 of the peg 4 is not especially small and thin, the number of parts and the number of manufacturing processes can be decreased by integrating the main body 90 with bearings supporting the winding shaft 50 and the wheel shaft 41.

INDUSTRIAL APPLICABILITY

The present invention can be used for a peg that is mounted in an electric guitar, an acoustic guitar, a classic guitar, an electric bass, a violin, a ukulele, a mandolin, a banjo, a shamisen, and other stringed instruments.

What is claimed is:

1. A peg for a stringed instrument, comprising:

a main body mounted in the stringed instrument;

a worm rotatably supported by the main body, the worm having a knob at an end thereof;

a worm wheel engaging with the worm, the worm wheel rotatably supported by the main body;

a winding shaft connecting to one side of the worm wheel in an axial direction, the winding shaft for winding a string of the stringed instrument; and bearing holes formed in at least two surfaces of the main body, the bearing holes supporting the winding shaft rotatably.

2. The peg for the stringed instrument according to claim 1, further comprising:

bearings connecting to the bearing holes that are formed in at least two surfaces of the main body.

3. The peg for the stringed instrument according to claim 1, further comprising:

a wheel shaft provided at another side of the worm wheel in an axial direction, the wheel shaft rotating unitarily with the winding shaft.

4. The peg for the stringed instrument according to claim 3, wherein the wheel shaft is caught at the edge of a small diameter hole that is formed at the inside of the worm wheel.

5. The peg for the stringed instrument according to claim 1, further comprising:

bearing holes that are formed in at least two surfaces of the main body, the bearing holes supporting the worm rotatably.

6. The peg for the stringed instrument according to claim 5, further comprising:

bearings connecting to the bearing holes that are formed in at least two surfaces of the main body.

7. The peg for the stringed instrument according to claim 1, wherein the winding shaft is mounted at the upper surface of the main body, and the main body is mounted at the upper surface of the head of the stringed instrument.

8. The peg for the stringed instrument according to claim 1, wherein the winding shaft is mounted at the lower surface of the main body, and the main body is mounted in an indentation that is formed on the lower surface of the head of the stringed instrument.

* * * * *